United States Patent [19]

Newkirk et al.

[11] 4,179,544

[45] Dec. 18, 1979

[54] FIBER FINISH COMPOSITIONS

[75] Inventors: David D. Newkirk, Woodhaven; Basil Thir, Wyandotte; Robert B. Login, Woodhaven, all of Mich.

[73] Assignee: BASF Wyandotte Corporation, Wyandotte, Mich.

[21] Appl. No.: 857,382

[22] Filed: Dec. 5, 1977

[51] Int. Cl.[2] ..... D02G 3/00

[52] U.S. Cl. ..... 428/395; 252/8.6; 252/52 A; 427/390 R; 428/375; 428/392

[58] Field of Search ..... 252/8.8, 8.7, 8.6, 8.9, 252/52 A, 399; 428/395, 375; 427/390; 260/45.95 H

[56] References Cited

U.S. PATENT DOCUMENTS

| | | | |
|---|---|---|---|
| 3,340,309 | 9/1967 | Weipert | 252/89 R |
| 3,504,041 | 3/1970 | Weipert | 252/89 R |
| 3,751,375 | 8/1973 | Bender | 260/45.95 H |
| 3,785,973 | 1/1974 | Bernholz et al. | 252/8.8 |
| 3,919,097 | 11/1975 | Park | 252/52 A |
| 3,925,588 | 12/1975 | Marshall et al. | 428/395 |
| 3,951,825 | 4/1920 | Carver | 252/8.7 |
| 3,963,628 | 6/1976 | Park | 252/8.9 |

*Primary Examiner*—George F. Lesmes
*Assistant Examiner*—E. Rollins Buffalow
*Attorney, Agent, or Firm*—Andrew E. Pierce; Norbert M. Lisicki

[57] ABSTRACT

A fiber finish composition, consisting of a mixture of a major amount of lubricant and a minor amount of a stabilizer of said fiber finish and a process for employment thereof.

12 Claims, No Drawings

FIBER FINISH COMPOSITIONS

BACKGROUND OF THE INVENTION

1. Field of the Invention

This invention relates to improved synthetic polyamide and polyester fiber finish compositions characterized by compositions which are sufficiently stable to resist oxidation at elevated temperatures without generating color formation on the fibers in the presence of oxides of nitrogen. More particularly, this invention relates to a fabric finish composition consisting of a major amount of a lubricant and an effective amount of stabilizer, said stabilizer being a reaction product of dicyclopentadiene, p-cresol, and isobutylene.

2. Description of the Prior Art

A fiber lubricant which is used either as fiber finish or spin finish has several functions. It may protect the newly spun fiber from fusion or breakage by controlling the yarn to metal friction between the yarn and machine guides, rollers, draw plates, heater plate and texturing false twist spindles or friction disks. The lubricant provides for yarn cohesion giving strength to the yarn by holding the yarn bundle together and by allowing the yarn to build up an acceptable package at the end of processing. Static electricity that is formed as the yarn rapidly moves through the processing equipment would also be controlled. Finally, the finish must protect machine surfaces from wear. Since the fiber is exposed to heat treatment during processing steps such as bulking and texturing, the fiber finish must show acceptable thermal stability in air as well as in the presence of oxides of nitrogen.

It is not uncommon for the fiber industry to employ propane fired ovens for the heat treatment of the fibers. These ovens generate appreciable quantities of oxides of nitrogen at elevated temperatures which can cause color formation of the fiber lubricant due to its instability in the presence of those oxides of nitrogen. Furthermore, during storage of the undyed yarn there is exposure to the exhaust of the fork lift trucks employed in the warehouses. These lift trucks can also generate excessive quantities of oxides of nitrogen.

Generally, fiber lubricants consisted of a base material such as mineral oil, alkylesters of fatty acids or vegetable oils, emulsifiers that allowed the lubricant to be applied from a water solution, and antistatic agents. Furthermore, special additives such as antioxidants, bactericides, friction modifiers or buffering agents were added. U.S. Pat. Nos. 3,785,973; 3,951,825 and British Pat. No. 1,440,552 teach the texturing of polyesters. U.S. Pat. No. 3,925,588 teaches a fiber finish for polyesters employing a particular phenolic compound as an antioxidant. U.S. Pat. No. 3,397,081 teaches the production of nylon fiber using a finish lubricant which contains an antioxidant formed by the reaction of diphenylamine and acetone.

SUMMARY OF THE INVENTION

In accordance with the present invention there is provided a fiber finish composition for synthetic fiber, particularly polyamide and polyester filaments which consists of a major amount of a lubricant and a minor effective amount of stabilizer. sufficient to prevent the oxidative decomposition of said fiber finish without generating color formation on the fiber in the presence of oxides of nitrogen.

DESCRIPTION OF THE PREFERRED EMBODIMENTS

In a preferred embodiment of this invention there is provided a process for the treatment of fiber with a fiber finish composition which consists of a mixture of (1) a major amount of a fiber finish and (2) a minor effective amount of stabilizer which is sufficient to inhibit the oxidative degradation of the lubricant, this preventing color formation on the fiber, in the presence of oxides of nitrogen. The fibers or products employing these fibers are generally heat cured at temperatures ranging from 100° C. to temperatures in excess of 200° C. Some manufacturers employ propane heaters, as opposed to electric heaters, which generate appreciable quantities of oxides of nitrogen. Fiber finish compositions therefore, must be stabilized against color formation upon exposure to heat in the presence of the oxides of nitrogen. The fiber finish composition is generally applied to the fiber following the filament formation upon emergence from the spinning tower. The quantities of lubricant employed can vary depending on the type of yarn, and the speed and complexity of the spinning operation. Generally, the amount employed will range from 0.2 to 5.0 weight percent based upon the weight of the yarn. Preferably however, the amount of lubricant ranges from about 0.5 to 1.5 weight percent based upon the weight of the yarn. It is necessary generally in processing fibers and finished products from those fibers, that the lubricants employed in the manufacture of such products, have sufficient stability in the presence of oxides of nitrogen that any decomposition products which form will not color the resulting yarn or fiber.

It is contemplated that the lubricant may be selected from the group consisting of polyoxyalkylene ether polyols, alkoxylates of fatty alcohols, alkoxylates of fatty acids and alkoxylates of lauryl mercaptan.

These polyoxyalkylene ether compounds are selected from the group consisting of those which are represented by the following formula:

$$X[C_3H_6O)_n—E—H]_x$$

wherein X is the residue of an organic compound containing therein x active hydrogen atoms, and is an integer, x is an integer greater than 1, the values of n and x are such that the molecular weight of the compound, exclusive of E, is at least 900, E is a polyoxyalkylene chain wherein the oxygen/carbon atom ratio is at least 0.5, and E constitutes 20 to 90 percent by weight of the compound. The compounds are more particularly defined in U.S. Pat. No. 2,674,619 which disclosure is incorporated herein by reference.

Another polyoxyalkylene ether compound may be represented by the formula:

$$Y(PK)_yH_y$$

wherein Y is the residue of an organic compound having Y reactive hydrogen and up to six carbon atoms, P is a hydrophobic polyoxyalkylene chain having an oxygen/carbon atoms ratio of not more than 0.40, the molecular weight of P and the value of y being such that the molecule excluding K as a molecular weight of at leasst about 400 to 900 and up to about 25,000 and K is a hydrophilic polyoxyalkylene chain which (1) contains oxyethylene groups in at least 5% by weight of higher molecular weight oxyalkylene groups having at least three carbon atoms in the structure, and (2) has an average oxygen/carbon atom ratio of greater than 0.40, K being present in the composition in an amount sufficient to constitute from about 10% to about 90% by weight of the total composition. These compounds are more particularly described in U.S. Pat. No. 3,101,374 which disclosure is incorporated herein by reference.

Still another class of lubricants are those described as $$R—O(A)_mH$$

wherein R is a straight chain alkyl group having from 8 to 20 carbon atoms, A is a mixture of oxypropylene and oxyethylene groups, the oxypropylene to oxyethylene ratio being from 0.1 to 1.0 to 1.0 to 0.1, and m is an integer such that the oxyalkylene groups constitute 50 to 90 percent by weight of the compound. These compounds are prepared either by random addition of oxyalkylene groups or sequential addition thereof. Some of these compounds are more particularly defined in U.S. Pat. Nos. 3,340,309 and 3,504,041 which disclosures are incorporated herein by reference.

Another preferred class of fiber lubricants are the alkoxylates of lauryl mercaptan. The alkoxylate of lauryl mercaptan is an alkoxylate addition product of oxyethylene and oxypropylene wherein the oxypropylene to oxyethylene ratio of said total weight being from 0.1 to 1.0 to 1.0 to 0.1 and m being an integer such that the oxyalkylene groups constitute from 55 to 90 percent by weight of the compound.

A further class of lubricants are those described as $$R—\overset{O}{\overset{\|}{C}}O\,(A)_mH$$

wherein R is an alkyl group having from 8 to 20 carbon atoms, A is a mixture of oxypropylene and oxyethylene groups, the oxypropylene to oxyethylene ratio being from 0.1 to 1.0 to 1.0 to 0.1 and m is an integer such that the oxyalkylene groups constitute 50 to 90 percent by weight of the compound. These compounds are prepared either by random addition of oxyalkylene groups or sequential addition thereof employing alkaline catalysts in a manner similar to those described in U.S. Pat. Nos. 3,340,309 and 3,504,041.

The stabilizer is the reaction product which is formed by reacting in the presence of Friedel-Crafts type catalyst, one mole of dicyclopentadiene and at least one mole of p-cresol and further reacting the reaction of these two with at least one-half mole of isobutylene. The quantities of stabilizer which may be employed ranges from about 0.05 to about 0.45 weight percent based on the weight of the fiber finish. Preferably, however, the amount of stabilizer is about 0.25 weight percent based on the weight of the fiber finish.

In accordance with the present invention, fiber finish compositions are effectively stabilized by having incorporated herein a minor amount of a stabilizer prepared by a process which involves reacting one mole of dicyclopentadiene having the following structural formula

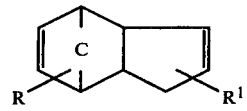

wherein R and $R^1$ are selected from the group consisting of hydrogen and methyl, with at least one mole of the phenolic compound selected from the group consisting of phenol, para-cresol, meta-cresol, para-ethyl phenol, and meta-ethyl phenol preferably in the presence of a Friedel-Crafts type catalyst. More specifically, the phenolic materials that are effectively reacted with the dicyclopentadiene in accordance with the first step of the present process may be defined as phenolic compounds conforming to the following structural formula:

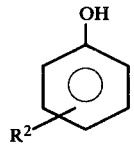

wherein $R^2$ is a radical selected from the group consisting of hydrogen, methyl, and ethyl and wherein $R^2$ is in a meta or para position. Preferred proportions of reactants in the resulting product are from 1.50 to 1.75 moles of phenolic compound per mole of the dicyclopentadiene. The reaction product of the dicyclopentadiene and phenolic compound is subsequently alkylated with at least one-half mole of a tertiary olefinic material per mole of the dicyclopentadiene, said tertiary olefinic material being selected from the group consisting of isobutylene, tertiary hexenes, and tertiary pentenes.

These two-stage reaction products are mixtures of compounds having the following structural formula:

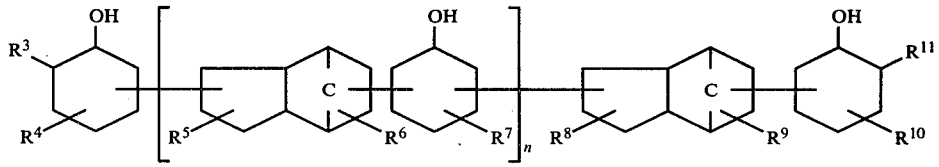

wherein $R^3$ and $R^{11}$ are tertiary alkyl radicals having from 4 to 6 carbon atoms and wherein $R^4$, $R^7$ and $R^{10}$ are selected from the group consisting of hydrogen, methyl, ethyl and tertiary alkyl radicals having from 4 to 6 carbon atoms and wherein $R^5$, $R^6$, $R^8$ and $R^9$ are selected from the group consisting of hydrogen and methyl and wherein n is 0 of a positive integer of 1, 2 or 3.

In the above list of compounds $R^3$ and $R^{11}$ may be selected to be the same or different. The same is true of $R^4$, $R^7$ and $R^{10}$ and $R^5$, $R^8$ and $R^9$. The dicyclopentadiene variety and $R^3$, $R^4$, $R^7$, $R^{10}$ and $R^{11}$ may be attached to either the ortho, meta or para positions or the phenolic varieties, most preferably the ortho or para positions. Preferred compounds are those where tertiary alkyl groups are attached ortho to OH group.

The amount of olefinic material to be employed will depend upon the phenolic compound used and also upon the molar ratio of phenolic compound and the dicyclopentadiene in the reaction product. Thus the product prepared from phenol and dicyclopentadiene will react with more of the olefinic compound than the product from para-cresol. Also a reaction product of phenol containing a 2:1 molar ratio of phenol and dicyclopentadiene will react with more olefin than a 1:1 product.

The reaction between the dicyclopentadiene and the phenolic compounds is effectively catalyzed by a Friedel-Crafts type catalyst, and in particular the more potent Friedel-Crafts catalysts such as aluminum chloride, zinc chloride, ferrous and ferric chloride and boron trifluoride, as well as complexes based on boron trifluoride. Boron trifluoride and complexes based on boron trifluoride are preferred catalysts for the first step of the disclosed process. The second step of the above described two-step reaction process, wherein the product obtained by reacting the dicyclopentadiene and a phenolic compound is further alkylated with a tertiary olefin, is effectively catalyzed by employing one or more of the customary acidic alkylation catalysts such as sulfuric acid, benzene sulfonic acid, toluene sulfonic acid, acid activated clays, boron trifluoride, zinc chloride, ferrous and ferric halides, aluminum halides and the stannous and stannic halides. Sulfuric acid, benzene sulfonic acid, toluene sulfonic acid and acid activated clay are preferred catalysts for the second step of the disclosed process.

The reaction defined as step one of the disclosed two-step process wherein the dicyclopentadiene is reacted with a phenolic compound is conducted at a temperature from 25° to 160° C. Preferred reaction temperatures are between 80° and 150° C. The reaction between the dicyclopentadiene and a phenolic compound may be started at room temperature and since the reaction is quite rapid and exothermic the heat of reaction may be used to obtain the final reaction temperature. If adequate cooling facilities are available the reaction may be carried out on a continuous basis.

The molar ratio of phenolic compound to the dicyclopentadiene employed in the reaction mixture of stage one of the disclosed process can be varied from 1:1 or 5 or more:1 moles of phenolic compound per mole of the dicyclopentadiene. The proportions usually employed range from 2:1 to 4:1 moles of phenolic compounds per mol of the dicylopentadiene, a preferred ration being 3:1.

The specific process conditions for the preparation of the stabilizer may be found in U.S. Pat. No. 3,751,375, the disclosure of which is incorporated herein by reference.

Those synthetic fibers which it is contemplated may be treated with the textile treating compositions of the instant invention include polyester and polyamide fibers. The polyester fibers are those in which the fiber-forming substance is any long-chain synthetic polymer composed of at least 85 percent by weight of an ester of a dihydric alcohol and terephthalic acid. The polyamide fibers are those in which the fiber-forming substances are any long-chain synthetic polyamide having recurring amide groups as an integral part of the polymer chain.

The following examples illustrate the invention.

EXAMPLE 1

Fiber finish compositions consisting of Polyol A and containing 0.0, 0.1, 0.3 and 0.5 weight percent of stabilizer B were applied to nylon carpet fiber to obtain about 1 weight percent loading of the lubricant on the fiber. Fiber samples treated with each of the above compositions were exposed to 150° C. for 30 minutes and then examined for yellow coloration. The fiber sample to which the fiber finish composition consisting of Polyol A and 0.0 weight percent of stabilizer B was applied showed definite yellow coloration. The fiber samples to which the fiber finish compositions consisting of Polyol A and 0.1, 0.3 or 0.5 weight percent of stabilizer B were applied showed no yellow coloration. Fiber samples treated with each of the above compositions were then exposed to an atmosphere of oxides of nitrogen and then examined for yellow coloration. The fiber samples to which the fiber finish composition consisting of Polyol A and 0.5 weight percent of stabilizer B was applied showed slight color formation. The fiber samples to which the fiber finish compositions consisting of Polyol A and 0.0, 0.1 or 0.3 weight percent of stabilizer B were applied showed no color formation.

Polyol A is an adduct of propylene oxide, ethylene oxide and fatty alcohols containing from 12 to 15 carbon atoms. The polyol has a molecular weight of 1300 containing 69 percent by weight propylene oxide and 25 percent by weight ethylene oxide.

Stabilizer B is a butylated reaction product of p-cresol and dicyclopentadiene prepared in accordance with the procedure outlined above.

EXAMPLE 2

A fiber finish composition consisting of Polyol A of Example 1 containing 0.25 weight percent of stabilizer B of Example 1 is applied to nylon carpet fiber to obtain about 1.0 weight percent loading of the lubricant on the fiber. The fiber is then heat cured at 150° C. for 30 minutes to nylon carpet backing with a latex binder in the presence of oxides of nitrogen generated by a propane heater source. No evidence of yellow coloration is noted. The same test carried out on the nylon carpet fiber employing the same polyol as lubricant without any stabilizer results in a slight yellow color of the nylon carpet backing.

The embodiments of the invention in which an exclusive property or privilege is claimed are defined as follows:

1. A synthetic polyamide or polyester fiber having deposited thereon a composition consisting essentially of a mixture of (1) a major amount of a polyoxyalkylene ether compound lubricant and (2) a minor effective amount of stabilizer sufficient to prevent oxidative degradation of said lubricant upon exposure to heat in the presence of oxides of nitrogen, said stabilizer a reaction product of one mole of dicyclopentadiene, at least one mole of p-cresol and at least one-half mole of isobutylene wherein the amount of stabilizer ranges from about 0.05 to about 0.45 weight percent based on the weight of the lubricant.

2. A synthetic polyamide or polyester fiber having deposited thereon the composition of claim 7 wherein the amount of stabilizer ranges from about 0.1 to 0.45 weight percent based on the weight of the lubricant.

3. A synthetic polyamide or polyester fiber having deposited thereon the composition of claim 7 wherein the amount of stabilizer is about 0.25 weight percent based on the weight of the lubricant.

4. A synthetic polyamide or polyester fiber having deposited thereon the composition of claim 7 wherein the lubricant is selected from the group consisting of polyoxyalkylene ether polyols, polyalkoxylates of fatty alcohols, polyalkoxylates of fatty acids and alkoxylates of lauryl mercaptan.

5. A synthetic polyamide or polyester fiber having deposited thereon the composition of claim 7 wherein the amount of lubricant ranges from about 0.2 to 5.0 weight percent based upon the weight of the fiber.

6. A synthetic polyamide or polyester fiber having deposited thereon the composition of claim 7 wherein the amount of lubricant ranges from about 0.5 to 2.0 weight percent based on the weight of the fibers.

7. A process for lubricating polyester or polyamide fibers which comprises treating said fibers with a composition consisting essentially of a mixture of a major amount of a polyoxyalkylene ether lubricant and a minor effective amount of stabilizer sufficient to prevent oxidative degradation of said lubricant upon exposure to heat in the presence of oxides of nitrogen, said stabilizer a reaction product of one mole of dicyclopentadiene, at least one mole of p-cresol, and at least one-half mole of isobutylene wherein the amount of stabilizer ranges from about 0.05 to about 0.45 weight percent based on the weight of the lubricant.

8. The process of claim 7 wherein the amount of stabilizer ranges from about 0.1 to 0.45 weight percent based on the weight of the lubricant.

9. The process of claim 7 wherein the amount of stabilizer is about 0.25 weight percent based on the weight of the lubricant.

10. The process of claim 7 wherein the lubricant is selected from the group consisting of polyoxyalkylene ether polyols, polyalkoxylates of fatty alcohols, polyalkoxylates of fatty acids and alkoxylates of lauryl mercaptan.

11. The process of claim 7 wherein the amount of lubricant ranges from about 0.2 to 5.0 weight percent based on the weight of the fiber.

12. The process of claim 7 wherein the amount of lubricant ranges from about 0.5 to 2.0 weight percent based on the weight of the fiber.

* * * * *